US006203313B1

(12) United States Patent
Holmes et al.

(10) Patent No.: US 6,203,313 B1
(45) Date of Patent: Mar. 20, 2001

(54) CANDLE HAVING RECONFIGURABLE SHAPE

(76) Inventors: Rebbecca L. Holmes; Darrell P. Holmes, both of 33 Creekside Way, Madison, WI (US) 53717

( * ) Notice: Subject to any disclaimer, the term of this patent is extended or adjusted under 35 U.S.C. 154(b) by 0 days.

(21) Appl. No.: 09/591,139

(22) Filed: Jun. 9, 2000

(51) Int. Cl.[7] ..... F23D 3/16
(52) U.S. Cl. ..... 431/288; 431/289
(58) Field of Search ..... 431/288–293, 431/126; D26/6; 362/161, 159

(56) References Cited

U.S. PATENT DOCUMENTS

| | | | | |
|---|---|---|---|---|
| D. 216,569 | | 2/1970 | Reiher . | |
| D. 216,570 | | 2/1970 | Reiher . | |
| D. 216,743 | | 3/1970 | Reiher . | |
| D. 216,744 | | 3/1970 | Reiher . | |
| D. 216,745 | | 3/1970 | Reiher . | |
| D. 216,746 | | 3/1970 | Reiher . | |
| 343,567 | * | 6/1886 | Clarke | 431/289 |
| D. 375,566 | | 11/1996 | Harter . | |
| D. 380,057 | | 6/1997 | Lukasik . | |
| 3,388,960 | * | 6/1968 | Cangialosi | 431/288 |
| 3,773,460 | * | 11/1973 | Tellier | 431/289 |
| 3,826,606 | * | 7/1974 | Hicks | 431/288 |
| 4,386,904 | | 6/1983 | Miyahara et al. . | |
| 4,826,428 | | 5/1989 | Lam . | |
| 5,127,922 | | 7/1992 | Bension . | |
| 5,380,237 | | 1/1995 | Kenyon . | |

FOREIGN PATENT DOCUMENTS

| | | | | |
|---|---|---|---|---|
| 18839 | * | 12/1980 | (EP) | 431/288 |
| 268288 | * | 10/1929 | (IT) | 431/288 |

* cited by examiner

*Primary Examiner*—James C. Yeung
(74) *Attorney, Agent, or Firm*—Craig A. Fieschko, Esq.; DeWitt Ross & Stevens S.C.

(57) ABSTRACT

A candle is constructed of a series of wax members arrayed in a stack, and extending between a top wax member and a base wax member. Each wax member has a through-hole, and a wick is closely received within the through-holes in the wax members to extend between the top wax member and the base wax member in the stack. The wick therefore retains the wax members about its length, but its flexibility and "play" allows for limited motion of the wax members with respect to each other about the wick. As a result, the wax members may be reconfigured so that the candle assumes different shapes, in accordance with the user's tastes and desires.

19 Claims, 1 Drawing Sheet

CANDLE HAVING RECONFIGURABLE SHAPE

FIELD OF THE INVENTION

This disclosure concerns an invention relating to candles.

BACKGROUND OF THE INVENTION

Candles have been known for centuries as a source of illumination and decoration. They are generally formed by encasing a wick—usually a combustible string or fabric-coated wire—within a solid body of wax, usually by placing the wick within a mold and then pouring the wax therein about the wick. Numerous examples of prior candles can be found in patents, catalogs, and other literature, but several representative examples of candles which are more pertinent to the present invention in appearance or construction are as follows:

U.S. Design Pat. Nos. 216,569; 216,570; 216,743; 216,744; 216,745; and 216,746 illustrate pillar candles, i.e., tower-like cylindrical candles having wicks extending from their tops. These candles appear to bear a variety of different types of decorative rings and tubes encircling their outer circumferences, in a variety of different orders. As a result, the outer surfaces of the candles vary in diameter and appearance along their heights.

U.S. Design Pat. No. 375,566 illustrates a pillar candle wherein its height is defined by a series of stepped cylinders, wherein successive cylinders increase in diameter proceeding towards the bottom of the pillar. The base of the pillar is defined by a conical section, and portions of the circumference of the conical section extend upwardly along the sides of the candle and along the cylindrical steps, thereby defining "ramps" which ascend along the sides of the cylindrical steps.

U.S. Design Pat. No. 380,057 illustrates a candle wherein a number of block-like wax sections are fused to the exterior surface of a wax pillar. Octagonal plate-like wax sections are then joined to the top and bottom ends of the pillar, situating the pillar and the fused blocks therebetween.

The foregoing candles have an interesting appearance, but this appearance is relatively static and cannot be altered by the users of the constructed candles. U.S. Pat. No. 4,826,428 illustrates a kit for constructing decorative candles wherein the candle appearance is potentially changeable. A cylindrical receptacle with an open top and bottom is provided in conjunction with a wick, a number of decorative and differently-shaped wax pieces, and a divider which may fit within the receptacle to divide its interior into several compartments extending along its height. The wick may be inserted within the interior of the receptacle to extend upwardly above the top of the receptacle, and the decorative wax pieces may then be poured into the receptacle about the wick to support the wick in an upright position. The wick may then be lit to use the separate wax pieces as fuel. If desired, the divider may be used within the receptacle to allow a user to put wax pieces of different types in different areas within the receptacle, rather than mixing them together.

The U.S. Pat. No. 4,826,428 therefore allows a user to pour wax pieces as desired within the receptacle to obtain a desired candle appearance, but this candle's appearance is only reconfigurable to the extent that the selection and arrangement of wax pieces within the receptacle may be varied. The overall shape of the candle may not be altered since the receptacle is necessary to maintain the wax pieces in the form of the candle, and the receptacle's outer configuration is immutable. A candle receptacle (such as that of U.S. Pat. No. 4,826,428) is also often undesirable to use because the candle will eventually burn down to such an extent that the receptacle will occupy far more volume than is necessary to contain the small candle therein. As a result, the candle is overly bulky, with the receptacle occupying the major part of the candle's appearance and detracting from the appearance of the candle. Further, an arrangement such as that of U.S. Pat. No. 4,826,428 may cause problems insofar as the loose wax pieces arranged about the wick may not burn properly, and may thereby result in soot production. Soot can dirty the user's home, and blacken the interior of the candle receptacle to such an extent that the appearance of the candle is greatly diminished. The receptacle may cause further difficulties with combustion since it may promote poor burning of the wick, and/or smothering of the candle flame, once the candle has burned down within the receptacle to such an extent that the waste gases from combustion (which are heavier than air) begin to collect within the receptacle.

It would therefore be desirable to have a candle available wherein its configuration may be varied in accordance with the user's tastes and desires; wherein no candle receptacle is necessary for use; and wherein the candle is clean-burning during use.

SUMMARY OF THE INVENTION

The candle invention, which is defined by the claims set forth at the end of this document, at least partially addresses the aforementioned problems. A basic understanding of some of the preferred features of the candle can be attained from a review of the following brief summary, with more details being provided elsewhere in this document.

In preferred versions of the candle, the candle is constructed of a series of wax members arrayed in a stack, and extending between a top wax member and a base wax member. Each wax member has a hole which enters it at one location on the surface of the wax member and exits it at another location on the wax member, i.e., the hole in each member is a through-hole. A wick is closely received within the through-holes in the wax members, and it extends between the top wax member and the base wax member through the stack. The wick therefore retains the wax members about its length to define the overall candle, but its flexibility and "play" allows for limited motion of the wax members with respect to each other about the wick. As a result, the wax members may be reconfigured so that the candle assumes different shapes, as illustrated by comparing FIGS. 1 and 2 of the accompanying drawings.

Preferably, the wick is restrained from withdrawal from the through-holes of at least one of the top wax member and the base wax member. As an example, the wick may be knotted adjacent to the base wax member so that the knot cannot be withdrawn through the through-holes of the base wax member and the wax members situated above it. This allows the candle to be lifted by the wick protruding above the top wax member. Another knot may be tied adjacent the top wax member to restrain all of the wax members between the two spaced knots. Additionally or alternatively, the wick may be affixed to the base wax member by an adhesive label or a bead of wax to prevent withdrawal of the wick from the candle when the candle is lifted by the wick.

Within the stack of wax members, the contacting faces of adjacent wax members are preferably configured so that they touch each other along only a portion of their contacting adjacent faces, and are spaced apart between other portions of the adjacent faces. As an example, each wax member may be formed with one or more concave faces so that when the wax members are stacked, the concave face of each wax member is in contact with the adjacent wax member. By forming the wax members in this fashion, the contacting faces of the wax members are at least partially spaced apart and have diminished contact area, thereby diminishing the chance that they will stick together (which is possible when the wax members are made of softer wax/paraffin, or are left to sit for an extended time in a warm area). This helps to maintain the ability of the user to reconfigure the candle.

The wax members may have different shapes, sizes, colors, and other visual features so as to further enhance the user's ability to reconfigure the appearance of the candle, for example, by stacking them in different orders, rotating wax members, moving them into different offsets or alignments with respect to each other, etc. Further, the different wax members may include different scents so as to successively provide different odors as the wick burns through different wax members, and/or the wax members may include different flame agents to provide different candle flame effects when burning (such as a brighter or colored flame). This permits unique features such as allowing the candle to simulate a walk through a meadow and into a forest, as by providing a bright flame and the smell of wildflowers in initial wax members, and then progressing into a dimmer green flame and the smell of pine in later wax members.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
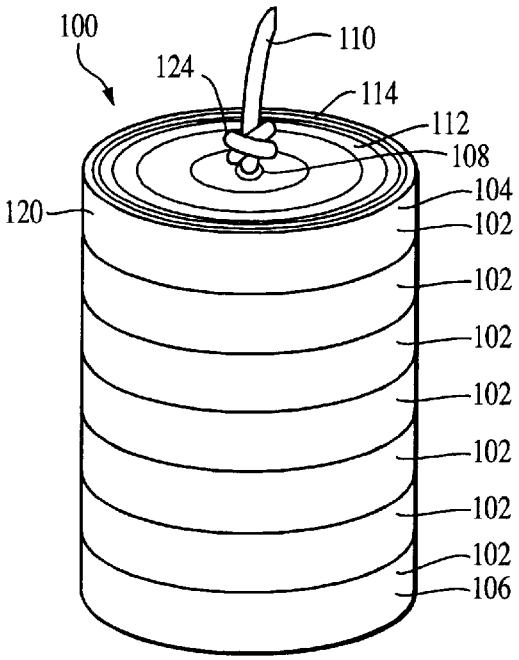
FIG. 1 is a perspective view of a first preferred version of the candle invention with wax members formed as cylinders, and wherein the wax members are arrayed to define a cylindrical pillar candle.
Figure 2:
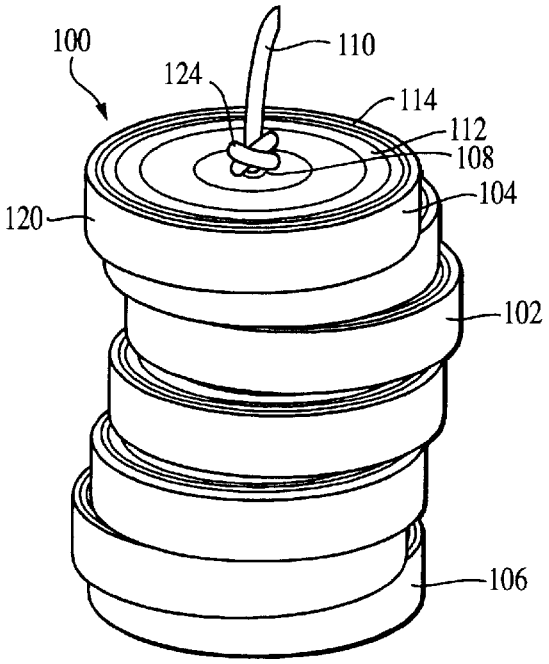
FIG. 2 is a perspective view of the candle invention of FIG. 1 with the wax members reconfigured for a different appearance.

In the drawings, wherein the same or similar features of the invention are designated in all Figures with the same reference numerals, FIG. 1 illustrates a first preferred version of the candle invention, which is designated generally by the reference numeral 100. The candle is formed of a number of wax members 102 arrayed in a stack between a top wax member 104 and a base wax member 106, wherein each wax member has a through-hole 108 defined therein. A wick 110 is strung through the through-holes 108 of the wax members 102 to complete the candle. Since candle wicks are generally flexible to some degree, the wax members 102 of the candle 100 may be shifted about the wick 110 as illustrated in FIG. 2 (or into a variety of other configurations) so that their through-holes 108 are no longer situated along a common axis, thereby allowing the user to reconfigure the candle 100 into a variety of different shapes as desired. Even where the wick 110 is extremely thick, includes wire, or is otherwise made partially or completely inflexible, it is noted that the appearance of the candle 100 may still be varied to some degree by simply rotating different wax members 102, which will allow alteration in the appearance of the candle 100 so long as the wax members 102 have nonuniform appearance about their circumference. Where wicks 110 are somewhat inflexible, the wax members 102 can usually still be allowed to translate horizontally by providing more "play" in the wick 110, since greater wick length allows a greater bending radius for the wick 110.

The wax members 102 are formed of common wax/paraffin candle material, readily available at most craft, hobby and hardware stores. The wax members 102 may (and preferably do) have different colors and scents included within their composition for more attractive appearance, and to provide a pleasant, air-freshening odor when burned. By stacking differently-colored wax members 102 with different scents to form the candle 100, a candle of highly attractive appearance is formed, and additionally the user may be obtain pleasant odors which change over time as the wick 110 burns through successive wax members 102 having different infused scents. The wax members 102 and/or the wick 110 may additionally be treated to generate colored flame by use of additives and methods known to the art, and as described in U.S. Pat. Nos. 4,386,904 and 5,127,922 and the patents cited therein. Therefore, the candle 100 can also be made to change the color of its flame as it burns through successive wax members 102. This allows a user to construct "themed" candles which change their color and scent over time; for example, a candle 100 might have four wax members 102 which reflect the changing of the seasons by having a green flame and a wildflower scent for summer, a brown flame and a woodsy scent for fall, a white flame and a peppermint scent for winter, and so on.

The wax members 102 illustrated in the Figures have a cylindrical shape, with a circular top face 112 bounded by a top face edge 114, and having the through-hole 108 defined at the center of the top face 112. Opposite the top face 112, a bottom face 116 is defined with a circular bottom face edge 118. The through-hole 108 preferably extends in a straight line between the top face 112 and bottom face 116. Between the top face edge 114 and the bottom face edge 118, a wax member side surface 120 extends circumferentially about each wax member 102. It is desirable to form at least one of the top face 112 or the bottom face 116 of the wax members 102 to be at least slightly concave, with the wax members 102 having greater thickness near the edges 114 and 118 of their top and bottom faces 112 and 116. This has the result of reducing the contact area between the wax members 102 when arrayed as shown in FIGS. 1 and 2, thereby decreasing sticking between the wax members 102. Sticking may more readily occur when softer wax/paraffin is used to form the wax members 102, and/or when the candle 100 is left in a warm area for an extended period, and thus it is desirable to form the candle 100 in such a manner that its wax members 102 avoid sticking. The use of concave faces 112 and/or 116 therefore makes it easier for the user to reconfigure the candle 100 by horizontally moving the wax members 102 to offset or align their through-holes 108. Most preferably, at least the top faces 112 of the wax members 102 are concave, since concave top faces 112 will also promote collection of melted wax at the top of the wax member 102 at which the wick is burning, thereby preventing a large degree of wax flow and providing for a longer-lasting candle 100.

The wick 110 may be any variety of common candle wick, including wicks made entirely of flammable fibers (i.e., string or fabric wicks), as well as wire wicks having flammable coatings or fabric coverings. It is noted that for a better-burning candle 100, the wick 110 should be sized to be closely received within the through-holes 108 of the wax members 102; by "closely received", it is meant that the through-hole 108 may have a diameter ranging in size from that of the nominal diameter of the wick 110 (in which case the wick 110 may need to be compressed to achieve insertion, and will be very tightly received within the through-holes 108 in the wax members 102) to several times the diameter of the wick 110, but wherein the burning of the wick 110 will still effect melting of the wax members 102 to fill the through-holes 108 to fuse the wax members 102 together after the candle 100 is initially lit. If a wick 110 is not closely received in the through-holes 108—for example, if the through-hole 108 is an order of magnitude larger—and the top of the wick 110 is lit, the wick 110 will burn down through the wax members 102 without achieving significant melting of the wax members 102: the wick 110 will burn, but the wax members 102 will not do so to the desired extent. In effect, the wax members 102 will not function so much as components of a candle, but will instead function as a wax container for a burning wick 110. Since the wick 110 must consume the wax of the wax members 102 if the candle 100 is to function well as a candle, the wick 110 should be so closely received in the through-holes of the wax members 102 that the wick 110 and wax members 102 burn in tandem with each other, rather than the wick 110 being rapidly consumed within the wax members 102. Most desirably, when the wick 110 begins consuming a particular wax member 102, the melted wax from this wax member 102 will very quickly seep down the through-hole 108 in the wax member 102 (and perhaps lower wax members 102) and surround the wick 110, thereby effectively joining it to the wax member(s) 102. This has the effect of joining the wax members 102 together after the candle 100 is lit, thereby fixing the configuration of the candle 100 in place. However, if it is desired to allow the candle 100 to be reconfigurable throughout its lifespan, the through-holes 108 can be made smaller so that they do not allow significant seepage of melted wax between the wax members 102, thereby maintaining the wax members 102 in an unfused state.

When making a candle 100 as illustrated in FIGS. 1 and 2, it is naturally desirable to configure the wax members 102 and candle 100 in such a manner that when the shape of the candle 100 is altered (to the form shown in FIG. 2 or other forms), the candle 100 will have a low likelihood of becoming imbalanced to such an extent that it will tip over. Tipping is deterred if the diameters of the wax members 102 about their through-holes 108 is relatively large with respect to their height, and to the overall height of the candle 100. Preferably, each wax member 102 will have an average diameter (as defined about its through-hole 108) which is at least four times greater than its average height (which is also defined along the through-hole 108).

Figure 3:
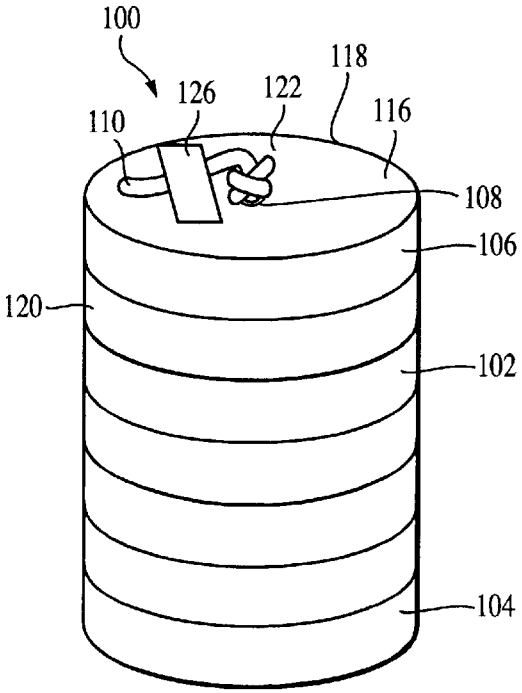
FIG. 3 is a bottom perspective view of the candle invention of FIG. 1, illustrating attachment of the wick at the bottom of the candle.

Tipping of the candle 100 is also deterred, and the transportability of the candle 100 is enhanced, if the candle 100 includes some form of means for maintaining the wax members 102 together in a unit about the wick 110 so that they cannot separate to a great extent and/or fall apart. This can be done by knotting the wick 110 adjacent the bottom face 116 of the base wax member 106, and sizing the resulting bottom knot 122 (FIG. 3) appropriately, so that lifting the wick 110 upwardly at the top of the candle 110 will cause the bottom knot 122 to engage the bottom face 116 of the base wax member 106. The bottom knot 122 will thereby allow lifting of the entire candle 100 by lifting the wick 110 adjacent the top wax member 104. The wick 110 can additionally (or alternatively) adhered to the bottom face 116 of the base wax member 106 by an adhesive sticker, which may conveniently be used to provide manufacturer contact information or other information to purchasers of the candle 100. Similarly, as illustrated in FIG. 1, a top knot 124 can be provided in the wick 110 adjacent the top face 112 of the top wax member 104 to prevent removal of the wax members 102 off of the wick 110. As other alternatives, the wick 110 may be sealed to the base wax member 106 or top wax member 104 by dripping molten wax onto the wick 110 to adhere it to the wax members 106/104; or an additional wax member, or a wax plug, may be fused to the bottom face 116 of the base wax member 106 with the wick 110 sandwiched between this additional wax member and the base wax member 106.

The candle 100 illustrated in the Figures may be easily and inexpensively formed in the following manner. Initially, the wax members 102 are partially formed by pouring molten wax within shallow cylindrical molds. Laboratory petri dishes have been found to serve as particularly inexpensive and convenient molds. Once the wax cools, it contracts to such an extent that the partially-formed wax members 102 may be easily tapped out of the petri dishes. Additionally, the highly heat-conductive petri dish (or other mold) facilitates more rapid solidification of the wax members 102 near their edges 114/116 and side surfaces 120, thereby causing the wax members 102 to solidify with the concave top face 112 mentioned earlier. The through-holes 110 are then formed in the wax members 102—possibly after several wax members 102 have been poured, solidified, and stacked—with a scalpel, low-speed drill, or heated rod. A wick 110, which is formed of common string, is then strung through the through-holes 108 of the wax members 102 so that they are arrayed in stacked fashion. A bottom knot 122 is tied in the wick 110 adjacent the bottom face 116 of the base wax member 106, with the bottom knot 122 having sufficient size that it cannot pull through the through-holes 108. Additionally, an adhesive sticker 126 (shown in FIG. 3) may adhere any trailing portion of wick 110 to the bottom face 116 of the base wax member 106. A top knot 124 may then be tied in the wick 110 adjacent the top face 112 of the top wax member 104 to prevent the removal of wax members 102 from the top of the candle 100. The candle 100 is then a ready-to-use form as shown in FIG. 1, and so long as the knots 122 and 124 are not spaced too closely (i.e., immediately adjacent the bottom face 116 of the base wax member 106 and the top face 112 of the top wax member 104), there will be sufficient flexibility and "play" in the wick 110 that the candle 100 can be reconfigured in forms such as shown in FIGS. 1 and 2. Of course, one of the knots 122 and 124 (if provided) may be untied by the user if greater flexibility is desired.

It is understood that various preferred features of the candle invention are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, it should be understood that the wax members need not take the cylindrical plate-like form illustrated in the exemplary candle 100 of the Figures, and may instead take a variety of other forms. As examples, plate-like wax members having triangular, square, hexagonal, etc. circumferences may be used, whereby rotation of the wax members about their wick allows the corners of adjacent wax members to be aligned or offset as desired. Plate-like wax members having non-symmetric or irregular shapes, with or without comers, are also possible. As an example, plate-like wax members could be formed and stacked in such a manner that they combine to take the general shape of a human body, and reconfiguration of the wax members can cause the body to stand up straight, lean over, or assume different poses. Non-plate-like wax members may also be used, such as spheres, cubes, or other regular or irregular solids. Finally, it should be realized that a user is not constrained to only use wax members having the same shape within the same candle. As an example, a candle might include four wax members including a plate-like square bottom member and a small spherical top wax member, with two spherical wax members situated therebetween. These wax members could be colored and decorated in such a manner that they appear in the form of a snowman (appearing, for example, similarly to the snowman depicted in U.S. Pat. No. 5,380,237).

Second, while it was previously noted that the use of one or more concave faces on the wax members is preferred as a means to avoid undue sticking between adjacent wax members, other measures could be taken to keep adjacent faces at least partially spaced away over a major portion of the faces. Convex faces, or the use of protrusions which extend outwardly from faces, can also assist in keeping the faces spaced. Concave faces are particularly preferred because they allow melted wax to connect within the concave bowl, but concave faces are not required.

Figure 4:
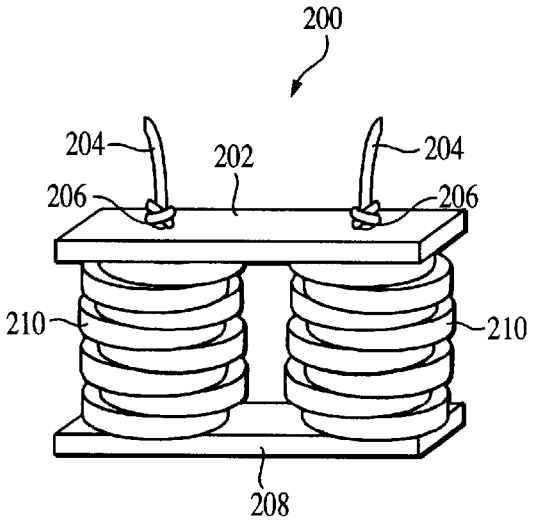
FIG. 4 is a side elevational view of an alternative candle invention, illustrating the use of two wicks in the same candle.

Third, the candle need not only have one wick, and it may include multiple wicks wherein each wick extends through a separate through-hole in each wax member (i.e., each wax member may include more than one through-hole). This possibility contemplates both multiple-wick versions of the embodiments discussed earlier, e.g., a candle such as the candle 100 with multiple wicks, and also candles wherein the use of multiple wicks leads to additional benefits in the ability to reconfigure the candles. As an example, as illustrated in FIG. 4, a candle 200 may have a plate-like top wax member 202 through which two wicks 204 extend, each wick 204 being carried in its own through-hole 206. A plate-like base wax member 208 may also be provided through which the same two wicks 204 extend. Intermediate wax members 210 can be provided in two adjacent stacks, with each stack carrying only one of the wicks 204. Each stack between the top and base wax members 202 and 208 may then be individually reconfigured. Additionally, the different stacks may interact, as where the wax members 210 on one stack have protrusions which may fit within apertures in wax members 210 on the other stack, so that selected wax members 210 on the stacks may be moved towards each other to connect. For instance, if the wax members in each stack are configured as gears, they may be moved into a meshing relationship and may be rotated about their wicks between the top and base wax members. It is also possible to have multiple wicks extend through a single through-hole in some wax members in a stack, and have the wicks later divide to each extend through their own through-holes in the same or different wax members. For instance, a candle may have a plate-like upper wax member wherein two wicks extend through the same through-hole, and lower wax members may be provided in two adjacent stacks, each stack carrying only one of the wicks. As the candle burns, the single flaming wick will divide into two flaming wicks as the wick burns into the lower wax members.

Fourth, it should be understood that the candle need not be provided to users in a completed form, but may instead be provided in the form of a kit which provides the completed candle when assembled by the user. As an example, a number of differently-sized and differently-shaped wax members may be provided to users along with wicks so that the users may construct candles having a desired basic configuration. Greater design versatility may be allowed to the user by providing multiple through-holes through each wax member, with these through holes being oriented through different faces at different directions, so that the user may orient the wax members as desired; for example, the cylindrical wax members 102 of FIGS. 1–3 could include both centrally-oriented through-holes, as well as through-holes which are situated eccentrically with respect to the axis of the wax members 102, and the user may choose one or more of the desired through-holes for insertion of one or more wicks.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A candle comprising:

a. at least two stacked wax members, each wax member having a through-hole defined therein, and b. a wick strung through the through-holes of the wax members, with the wax members being laterally movable with respect to each other in a direction at least substantially perpendicular to the wick when the wax members are stacked about the wick.

2. The candle of claim 1 wherein the wick is sized to be closely received within the through-holes of the wax members.

3. The candle of claim 1 wherein the wick bears at least one knot therein, the knot being sized to prevent its passage through the through-holes of the wax members.

4. The candle of claim 3 wherein the wick bears a pair of knots between which two or more of the wax members are situated, the knots thereby retaining these wax members on the wick.

5. The candle of claim 1 wherein adjacent wax members on the wick face each other at adjacent faces, and wherein the adjacent faces are configured to be spaced apart across major portions of their surfaces when the adjacent faces are contacting.

6. The candle of claim 5 wherein at least one of the adjacent faces is defined by a concave spherical section.

7. The candle of claim 1 wherein each wax member has an average diameter defined about its through-hole, and an average height defined along the through-hole, and wherein each wax member has an average diameter at least four times greater than its average height.

8. The candle of claim 1 wherein two or more of the wax members have at least one of:

a. different colors;

b. different shapes; and c. different scents.

9. A candle comprising:

a. two or more wax members arrayed in a stack between a top wax member and a base wax member, each wax member having a through-hole entering it at one location on the wax member and exiting it at another location;

b. a wick sized to be closely received within the through-holes of the wax members, the wick extending through the through-holes of the wax members and protruding from the top wax member, wherein the wax members are laterally shiftable with respect to each other to allow their through-holes to be moved between positions of coaxial alignment and non-coaxial alignment.

10. The candle of claim 9 wherein the wick is affixed to the base wax member.

11. The candle of claim 10 wherein the wick is affixed to the base wax member by an adhesive label.

12. The candle of claim 9 wherein the wick bears at least one knot therein, the knot being sized to hinder its passage through the through-holes of the wax members.

13. The candle of claim 12 wherein the wick bears at least two knots therein, with the wax members being situated between the knots.

14. The candle of claim 9 wherein adjacent wax members in the stack face each other at adjacent sides, and wherein the adjacent wax members contact each other along only a portion of the adjacent sides, whereby spacing is defined between other portions of the adjacent sides.

15. The candle of claim 9 wherein adjacent wax members in the stack face each other at adjacent sides, and wherein at least one of the adjacent sides is a curved concave surface, thereby defining spacing between portions of the adjacent sides.

16. The candle of claim 9 wherein adjacent wax members in the stack face each other at adjacent sides, and wherein the adjacent sides are at least partially spaced apart.

17. A candle comprising:

a. a series of stacked wax members including a top wax member and a base wax member, each wax member having a through-hole defined therein, b. a wick extending through the through-holes in the wax members between the top wax member and the base wax member, the wick being restrained from withdrawal from the through-holes of at least one of the top wax member and the base wax members wherein the wax members are shiftable with respect to each other in planes oriented at least substantially perpendicular to the wick.

18. The candle of claim 17 wherein the wick bears a knot therein, the knot being sized greater than the through-hole in at least one of the top wax member and the base wax member, thereby preventing withdrawal of the wick from the through-hole.

19. The candle of claim 17 wherein the wick is sealed to at least one of the top wax member and the base wax member by at least one of:

a. a bead of wax; or b. an adhesive label.

* * * * *

UNITED STATES PATENT AND TRADEMARK OFFICE

CERTIFICATE OF CORRECTION

PATENT NO. : 6,203,313 B1
DATED : March 20, 2001
INVENTOR(S) : Rebbecca L. Holmes and Darrell P. Holmes It is certified that error appears in the above-identified patent and that said Letters Patent is hereby corrected as shown below:

Claim 17, column 10,
Line 16: delete "members" and substitute therefor -- member, --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*